US007766324B2

(12) United States Patent
Tamura et al.

(10) Patent No.: US 7,766,324 B2
(45) Date of Patent: Aug. 3, 2010

(54) SHEET STACKING APPARATUS, SHEET PROCESSING APPARATUS AND IMAGE FORMING SYSTEM

(75) Inventors: Hitoshi Tamura, Tokyo (JP); Masaaki Uchiyama, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 0 days.

(21) Appl. No.: 11/947,879

(22) Filed: Nov. 30, 2007

(65) Prior Publication Data

US 2009/0020939 A1 Jan. 22, 2009

(30) Foreign Application Priority Data

Jul. 17, 2007 (JP) ..... 2007-185433

(51) Int. Cl.
*B65H 31/04* (2006.01)
*B65H 31/26* (2006.01)

(52) U.S. Cl. ..... 271/213; 271/220

(58) Field of Classification Search ..... 271/213, 271/215, 217, 220; 414/788.9, 789.1, 791.2; 270/58.12, 58.13
See application file for complete search history.

(56) References Cited

U.S. PATENT DOCUMENTS 6,209,865 B1 * 4/2001 Regimbal et al. ..... 271/220
6,871,851 B2 * 3/2005 Tamura et al. ..... 271/221
7,014,183 B2 * 3/2006 Tamura et al. ..... 270/58.09

FOREIGN PATENT DOCUMENTS

| | | |
|---|---|---|
| JP | 2001-187655 | 7/2001 |
| JP | 2001-348155 A | 12/2001 |
| JP | 2003-2524 A | 1/2003 |
| JP | 2003-2534 | 1/2003 |
| JP | 2006-21874 A | 1/2006 |

OTHER PUBLICATIONS

Japanese Office Action for Japanese Patent Application No. 2007-185433 mailed May 26, 2009 with English translation.
Japanese Office Action for Japanese Patent Application No. 2007-185433 mailed Dec. 8, 2009 with English translation.

* cited by examiner

*Primary Examiner*—David H Bollinger
(74) *Attorney, Agent, or Firm*—Cantor Colburn LLP

(57) ABSTRACT

A sheet stacking apparatus having: a sheet discharge tray to move upward and downward; an alignment section including first and second regulating members to align a side edge of a sheet on the tray; a first drive section for moving the tray upward or downward; a second drive section for moving the regulating members in a conveyance width direction; and a control section for controlling the first and the second drive sections so as to: align the side edge of the sheet discharged on the tray on the basis of the position of the first regulating member; when a predetermined amount of the sheets are discharged on the tray, separate the sheets from the first regulating member and the second regulating member by moving the tray or the alignment section and, after that, move the regulating members in the conveyance width direction; and align the side edge of the sheets.

7 Claims, 6 Drawing Sheets

SHEET STACKING APPARATUS, SHEET PROCESSING APPARATUS AND IMAGE FORMING SYSTEM

RELATED APPLICATION

This application is based on Japanese Patent Application No. 2007-185433 filed on Jul. 17, 2007, in Japanese Patent Office, the entire content of which is hereby incorporated by reference.

BACKGROUND

1. Field of the Invention

The present invention relates to an improvement of a sheet discharge part in a sheet processing apparatus used in combination with an image forming apparatus.

2. Description of the Related Art

When delivering sheets on which images are formed or sheets on which images are formed and post processing such as punch processing, binding processing, and punching processing is conducted, to a sheet discharge tray, sorting processing is conducted and delivered.

In the sorting processing, there is a shift processing which is simple and most widely conducted, and this shift processing is a processing in which, for each number of setting sheets, the sheets are displaced in a conveyance width direction, that is, a direction perpendicular to the conveyance direction and parallel to the sheet surface of the conveyed sheet, and discharged.

As the shift processing, a method in which, in the sheet discharge port, the sheet is freely dropped from sheet discharge port and stacked on the sheet discharge tray, is common.

In such a shift sheet discharge, because the sheet is separated from sheet discharge port and freely dropped, the deviation is generated in the movement of the sheet in the process of the drop, and the grounding position on the sheet discharge tray of the sheet, is deviated, and there is a problem that the alignment condition of the sheet on the sheet discharge tray is not so good.

In Japanese Unexamined Patent Application Publication No. 2001-187665 (hereinafter referred to as JPA 2001-187655), in order to solve this problem, it is proposed that an aligning means for guiding the sheet on the stage that the sheet is not separated from the sheet discharge port is used, and the sheet is aligned.

In JPA 2001-187655, in order to shift the sheet, the discharge tray is displaced in the conveyance width direction.

Although the shift processing is not conducted, in Japanese Unexamined Patent Application Publication No. 2003-2524 (hereinafter referred to as JPA 2003-2524), a regulating member which guides the side edge of the sheet on the sheet discharge tray is used.

In JPA 2001-187655 and JPA 2003-2524, when the sheet is placed on the sheet discharge tray, the sheet is guided not by free-dropping, but by regulating member, and stacked.

Then, for the shift processing which changes the sheet position to the conveyance width direction, in JPA 2001-187655, the sheet discharge tray is displaced, and in JPA 2003-2524, it does not have the shift function.

In the shift processing of the JPA 2001-187655, the sheet discharge tray displaces in the conveyance width direction. Therefore, when a lot of sheets are stacked on the sheet discharge tray, because the sheet discharge tray having a large mass reciprocates and the inertia functions, the drive mechanism corresponding to this, is necessary, and a large drive mechanism becomes necessary.

Further, because the stacked sheets repeat the movement in the conveyance width direction, there is a case where the alignment condition is broken.

Further, because the sheet discharge tray moves in the conveyance width direction, when the sheet discharge tray is elevated and lowered, there is a problem that the drive mechanism of the sheet discharge tray becomes complicated.

SUMMARY

One aspect of the present invention is to provide a sheet stacking apparatus comprising: a sheet discharge tray adapted to support on which discharged sheets, and to move upward and downward; an alignment section including a first regulating member and a second regulating member with which the alignment section aligns a side edge of a sheet discharged on the sheet discharge tray; a first drive section for moving the sheet discharge tray or the alignment section upward or downward; a second drive section for moving the first regulating member and the second regulating member in a conveyance width direction; and a control section for controlling the first drive section and the second drive section, wherein the control section controls the first drive section and the second drive section so as to: align the side edge of the sheet discharged on the sheet discharge tray on the basis of the position of the first regulating member, by fixing the position of the first regulating member and moving the second regulating member in the conveyance width direction; when a predetermined amount of the sheets are discharged on the sheet discharge tray, separate the sheets discharged on the discharge tray from the first regulating member and the second regulating member by moving the sheet discharge tray or the alignment section and, after that, move the first regulating member and the second regulating member in the conveyance width direction; and align the side edge of the sheets discharged on the sheet discharge tray by fixing the position of the second regulating member and moving the first regulating member in the conveyance width. Further aspect of the present invention is to provide a sheet processing apparatus comprising: a shift member adapted to discharge a sheet by displacing the sheet in a conveyance width direction; and the above-sheet stacking apparatus. Further aspect of the present invention is to provide an image forming system comprising: an image forming apparatus for forming an image on a sheet; and the above-sheet processing apparatus which carries out a processing to a sheet carrying an image formed by the image forming apparatus.

DETAILED DESCRIPTION OF THE PREFERRED EMBODIMENTS

Next, although by using the shown embodiments of the present invention, the description is made, however, the present invention is not limited to the embodiments.

Figure 1:
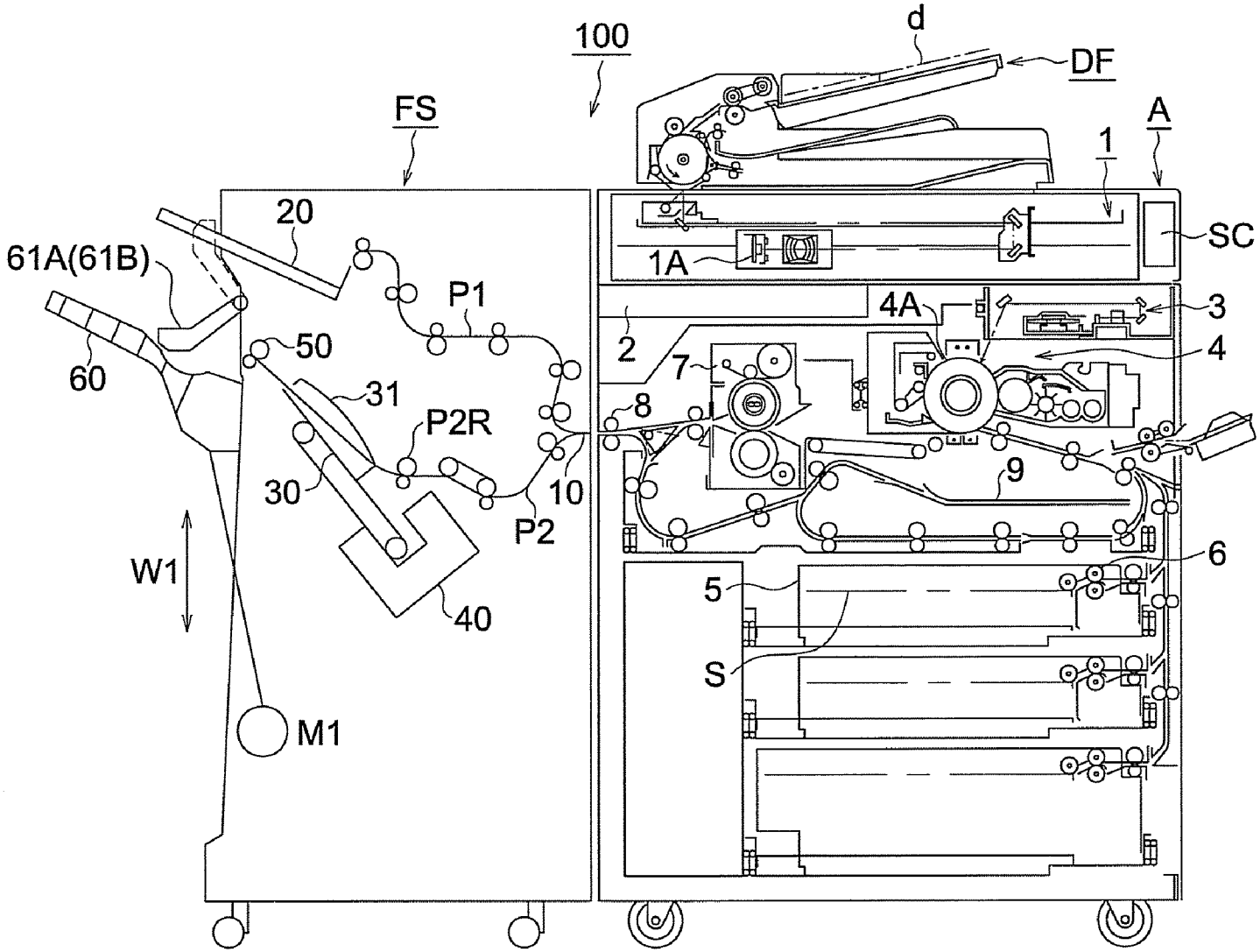
FIG. 1 is an overall drawing of the image forming system having a sheet stacking apparatus and a sheet processing apparatus.

FIG. 1 is an overall view of the image forming system having the sheet stacking apparatus and the sheet processing apparatus.

The image forming system 100 is provided with the image forming apparatus A and the post-processing apparatus FS.

The image forming apparatus A is provided with the image reading part 1, image processing part 2, image writing part 3, image forming part 4, cassette sheet feed part 5, sheet feed roller part 6, fixing apparatus 7, sheet discharge part 8, automatic double sides copy sheet feeding part (ADU) 9 and system control part SC.

On the upper part of this image forming apparatus A, the automatic document feeding apparatus DF is mounted. The document placed on the document table of the automatic document feeding apparatus DF is conveyed in the arrow mark direction, the image of the single surface or images of double surfaces are read by the optical system of the image reading part 1, and read into the CCD image sensor 1A.

The analog signal photoelectrically converted by the CCD image sensor 1A, is subjected to analog processing, A/D conversion, shading correction, and image compression processing in the image processing part 2, and then the signal is sent to the image writing part 3.

In the image writing part 3, the output light from the semiconductor laser is irradiated on the photoreceptor drum 4A of the image forming part 4, and a latent image is formed. In the image forming part 4, processing such as charging, exposing, developing, transferring, separating, cleaning, are conducted, and the image is transferred onto the sheet S conveyed from the cassette sheet feed part 5 through the sheet feed roller part 6.

The sheet S on which the image is carried, is subjected to fixing process by the fixing apparatus 7 and discharged from the sheet discharge part 8.

The system control part SC controls the overall operation of the image forming system 100.

That is, the system control part SC simultaneously control other than the image forming apparatus A, also the operation of post-processing apparatus FS.

The sheet S discharged from the sheet discharge part 8 of the image forming apparatus A is delivered through the conveyance path P1 or the conveyance path P2 to the sheet discharge tray 20 or sheet discharge tray 60.

The sheet discharge tray 20 is a fixed sheet discharge tray, and does not conduct post-processing, and when small-number of job, the sheet S is discharged to the sheet discharge tray 20.

The sheet discharge tray 60 is a tray which elevates and lowers as shown by arrow-mark W1, by the drive of the motor M1 as the first drive section and when a lot of image formation, and when staple processing is conducted, the sheet S is discharged on the sheet discharge tray 60.

In the staple processing, the sheet S elevates on the intermediate tray 30 from the sheet introduction part 10 through the conveyance path P2. The intermediate tray 30 is inclined as shown in the drawing, and after the sheet S sent from the conveyance path P2 is elevated in the left slanting direction on the intermediate tray 30, after separating from the sheet discharge roller P2R of the conveyance path P2, slides and drops on the intermediate tray 30, and stacks on the staple position.

On the stage on which a predetermined number of sheets S are stacked, the stapler 40 is operated and staple-processes the sheet bundle.

The sheet bundle after staple processing elevates on the intermediate tray 30 and discharged to the sheet discharge tray 60 by the sheet discharge roller 50.

In the shift processing, the sheet S discharged from the sheet discharge roller P2R of the conveyance path P2 slides and drops on the intermediate tray 30, and stops at the predetermined position.

After the stop of the sheet S, the aligning plate 31 as the shift member, reciprocally moved in the conveyance width direction parallel to the surface of the sheet and perpendicular to the conveying direction, and aligns the sheet S.

Although not shown, the alignment of the sheet S by the aligning plate 31 is conducted by the well-known mechanism.

That is, a pair of aligning plates 31 arranged on the both sides of the intermediate tray 30 reciprocally moves 1 to several times, in the conveyance width direction and the sheet S is aligned.

In the shift processing, the aligning position of the sheet is set by the aligning plate 31, and changed to the conveyance width direction for each shift unit of a predetermined amount.

Figure 2:
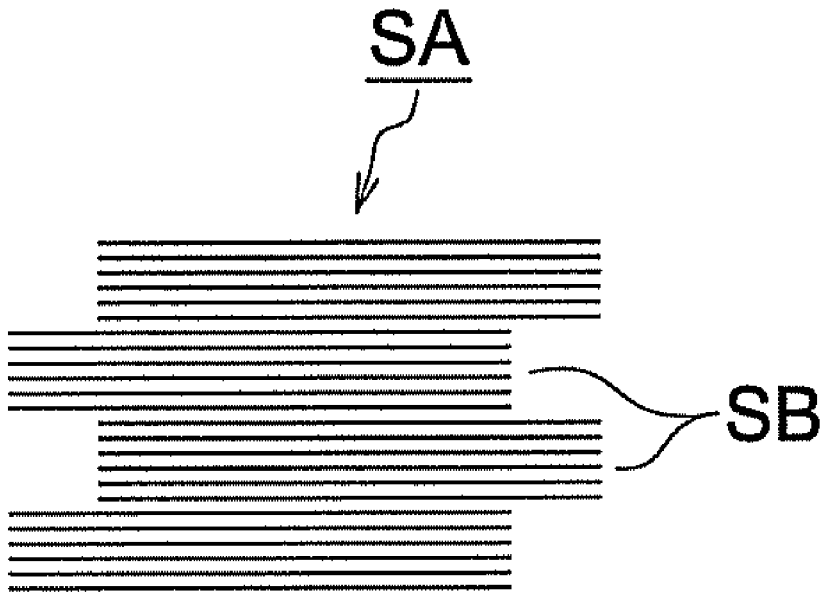
FIG. 2 is a view showing a sheet bundle which is shift processed.

As the result, as shown in FIG. 2, the sheet bundle SA which is shift processed, is stacked on the discharge tray 60.

In the field of POD (Print On Demand), as shown in FIG. 2, to the sheet bundle SA, there is many cases that the processing is conducted further by the off-line book-binder for each shift unit.

For this purpose, for example, in the book-binding processing, it is required that there is no concave and convex on the side edge SB of the sheet bundle for each shift unit, and side edge is flat surface like.

The sheet stacking apparatus described below, satisfies such needs.

Figure 3:
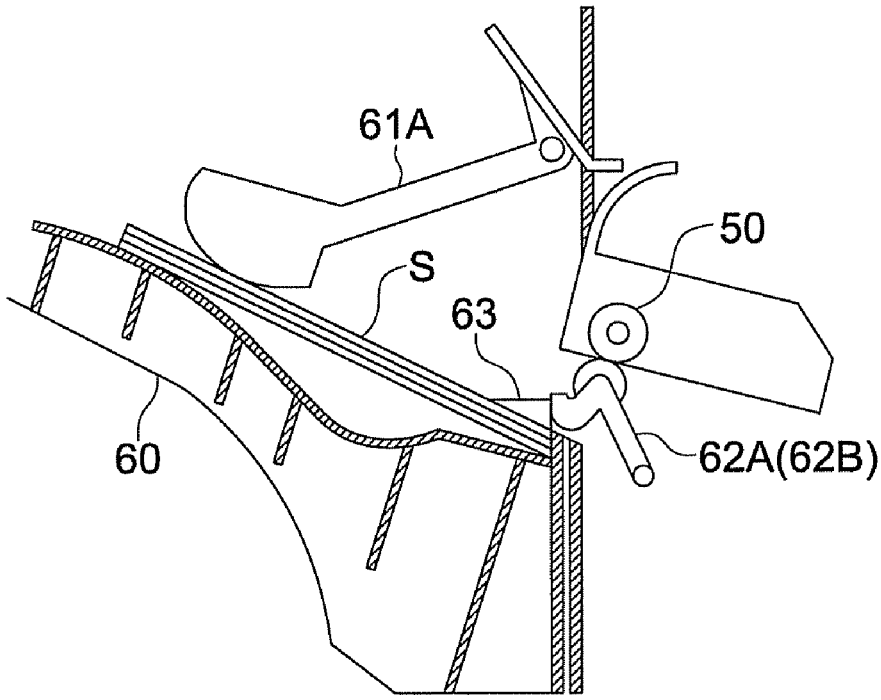
FIGS. 3 (*a*) and 3 (*b*) are front sectional views of the sheet stacking apparatus.
Figure 3:
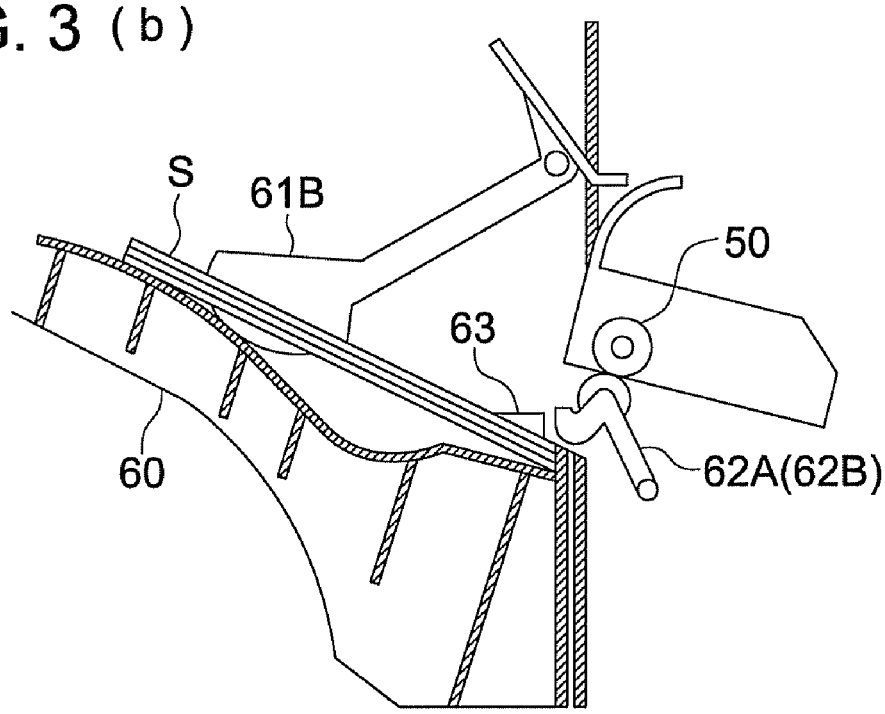
Figure 5:
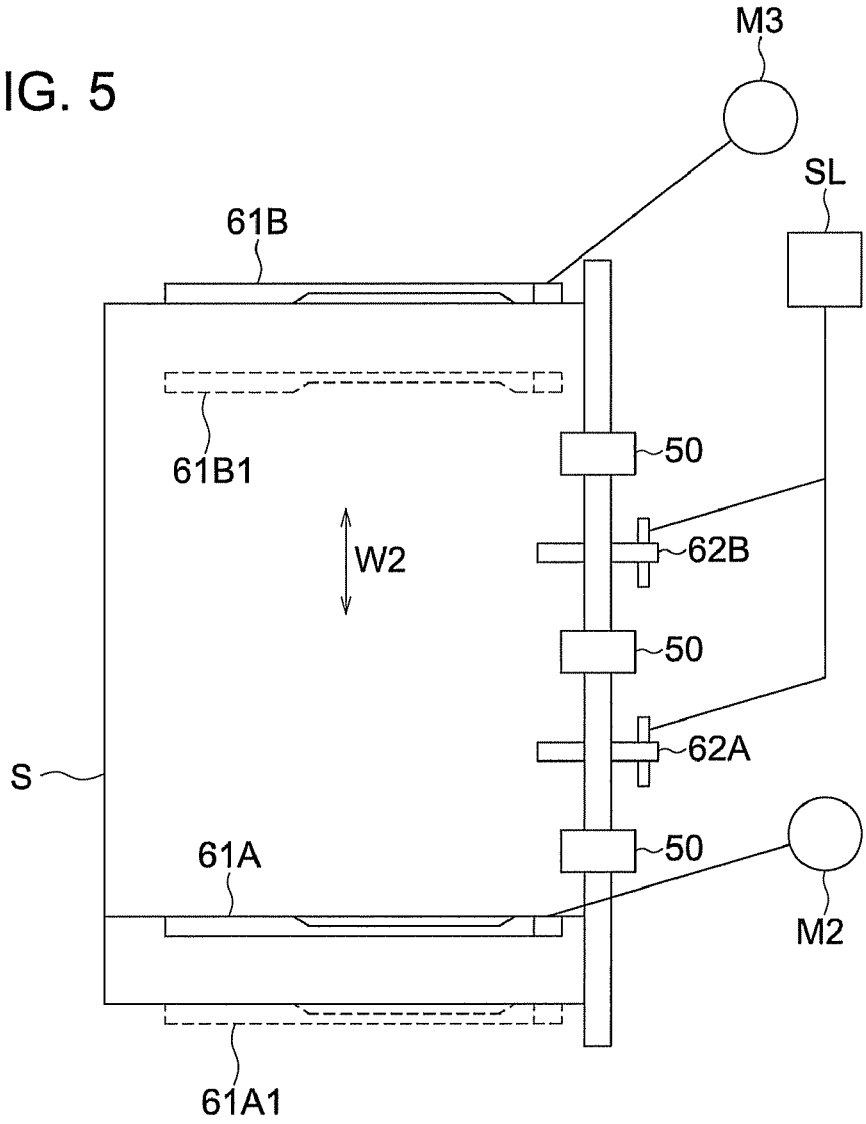
FIG. 5 is a plan view of the sheet stacking apparatus.
Figure 6:
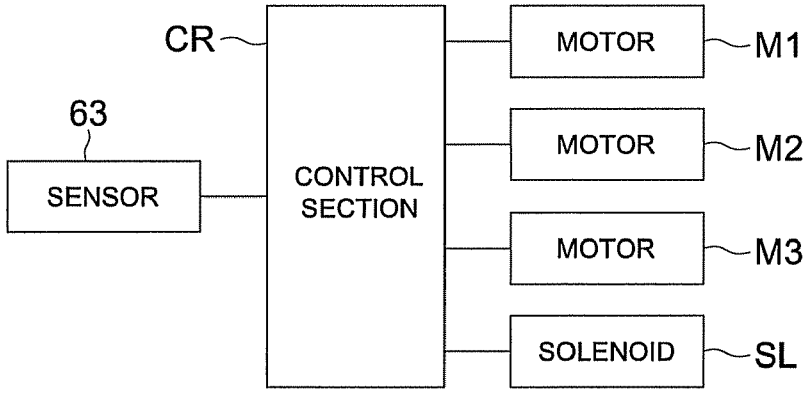
FIG. 6 is a block diagram of the control system for conducting the shift control.
Figure 7:
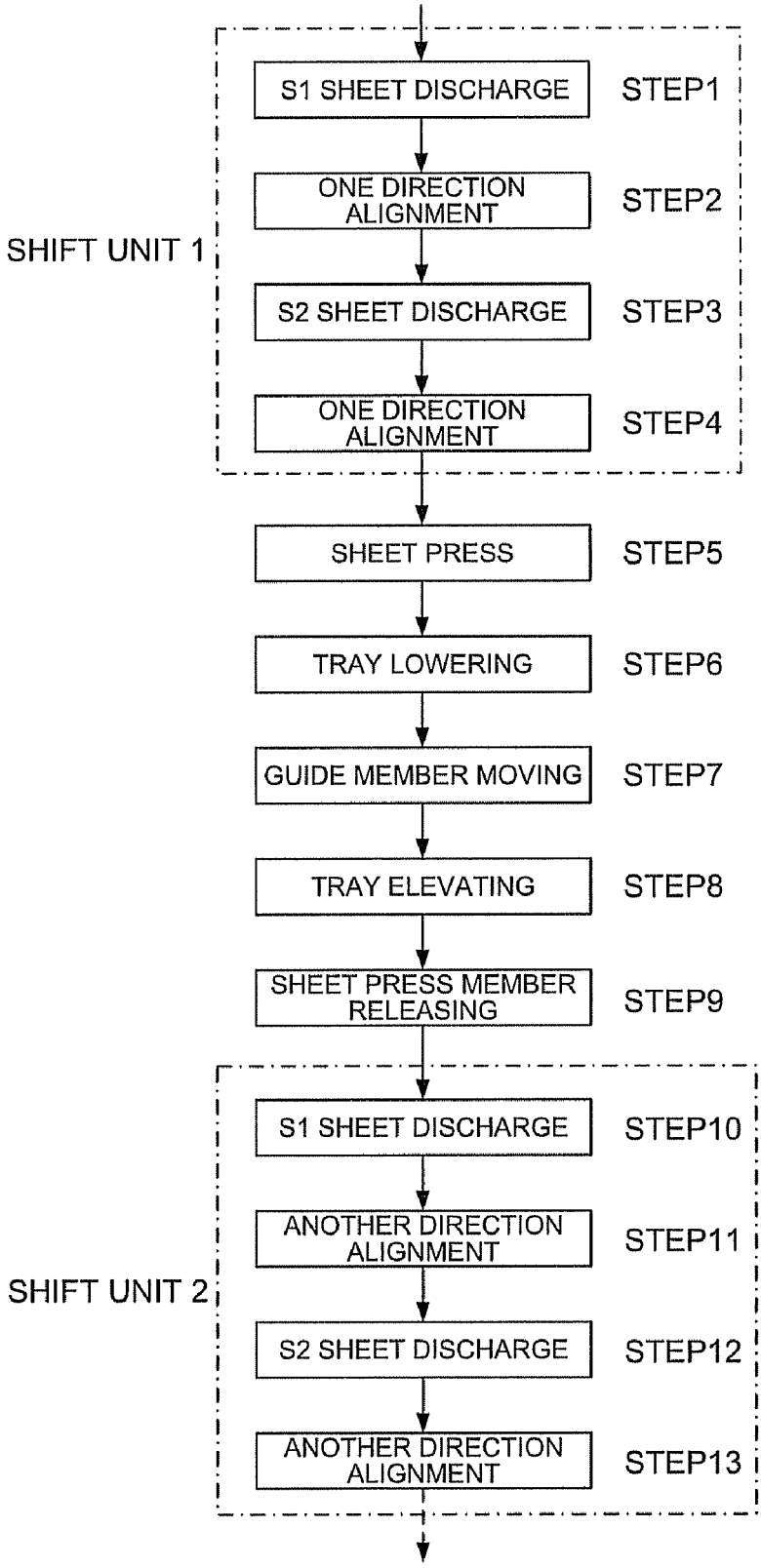
FIG. 7 is a view showing the operation sequence of the sheet stacking apparatus.

FIGS. 3(*a*), 3(*b*), and 4 are front sectional views of the sheet stacking apparatus according to the embodiment of the present invention, FIG. 5 is a plan view of the sheet stacking apparatus, FIG. 6 is a block diagram of the control system for conducting the shift control, FIG. 7 is a view showing an operation sequence of the sheet stacking apparatus.

The sheet stacking apparatus which discharges the sheet S to the sheet discharge tray 60 has the sheet discharge tray 60, the regulating member 61A as the first regulating member, the regulating member 61B as the second regulating member, the pressing member 62A, 62B, and the sensor 63.

As shown in FIG. 5, a pair of regulating members 61A, 61B and a pair of pressure members 62A, 62B are arranged parallel in the conveyance width direction.

Hereupon, the sheet discharge roller 50, as shown in FIG. 3, 5, the upper roller which is the drive roller, and the lower roller which is a following roller, and arranged three in parallel in conveyance width direction.

The regulating members 61A, 61B are to align the sheet S discharged by the sheet discharge roller 50, and separates from the sheet discharge roller 50, in the conveyance width direction, and the sheet S discharged from the sheet discharge roller 50 is guided to a predetermined position in the conveyance width direction, and is grounded on the sheet discharge tray 60. By the regulating members 61A, 61B, the side edge in the conveyance width direction of the sheet S is aligned very accurately.

At the sheet discharge time, as described next, one direction alignment in which the regulating member 61A is fixed, the regulating member 61B is moved in the conveyance width direction, and the sheet S is brought into contact with the regulating member 61A, or another direction alignment in which the regulating member 61B is fixed, the regulating member 61A is moved in the conveyance width direction, and the sheet S is brought into contact with the regulating member 61B, is conducted.

The movement of the conveyance width direction of the regulating member 61A is conducted by the motor M2 which functions as the second drive section, and the movement of the conveyance width direction of the regulating member 61B is conducted by the motor M3 which functions as the second drive section.

Figure 4:
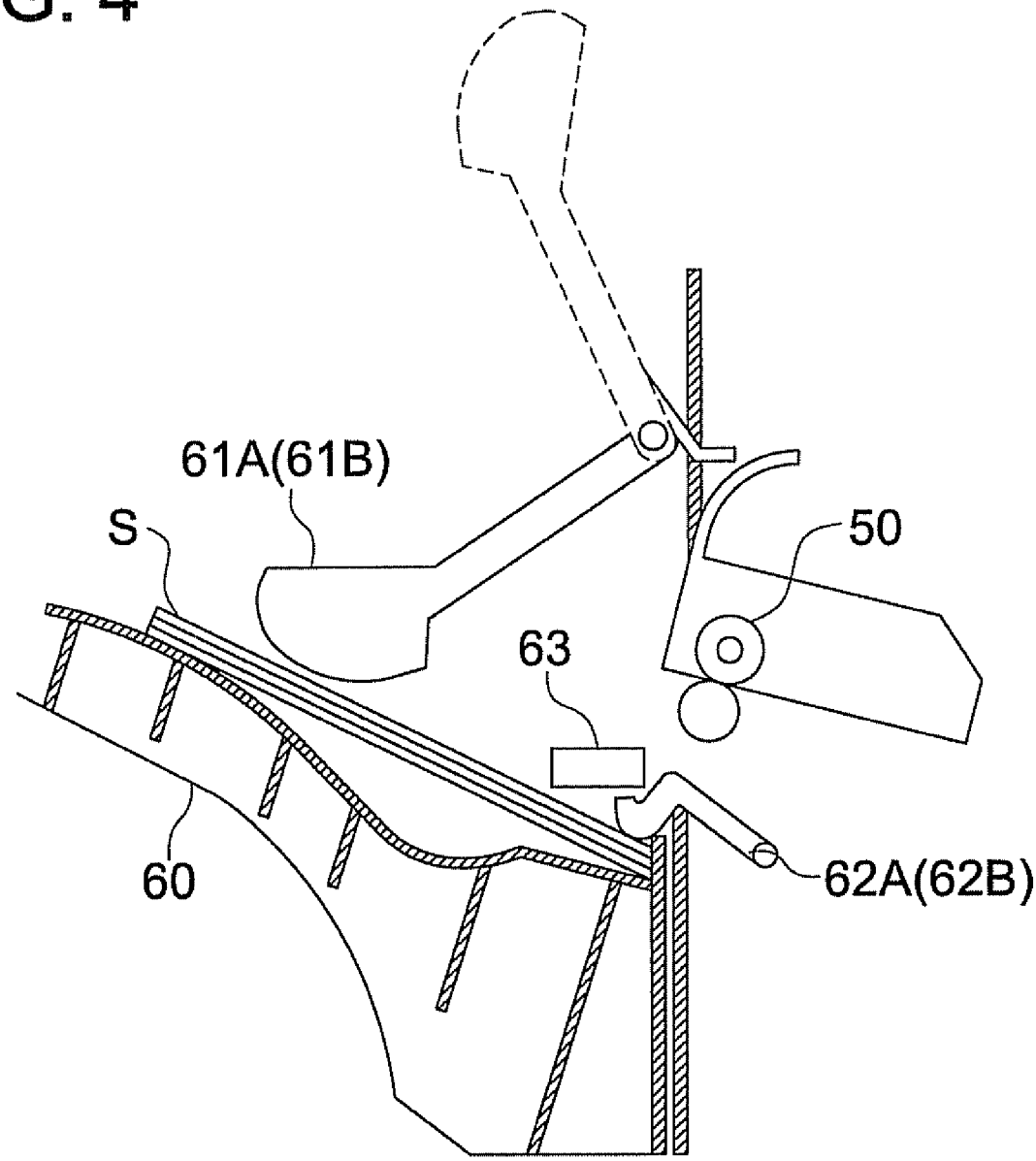
FIG. 4 is a front sectional view of the sheet stacking apparatus.

The regulating member 61A and 61B, further, by the manual operation of the operator, can rotate to the retreat position shown by dotted line of FIG. 4.

Pressing members 62A, 62B are driven by the solenoid SL, as shown by FIGS. 4 and 5, press the sheet S on the discharge sheet tray 60, and hold so as not to collapse the alignment condition.

By using FIG. 7, the alignment of the sheet S in the sheet discharge at the time of shift processing will be described.

In STEP 1-STEP 4 . . . , the alignment in the shift processing of 1 unit is conducted.

The operation of motor M1 for driving the sheet discharge tray 60, the operation of motors M2, M3 for driving the regulating members 61A, 61B, and the operation of solenoid SL for driving the pressing members 62A, 62B is conducted under the control of the control part CR of FIG. 6.

In STEP 1, the sheet stacking apparatus is in the condition shown in FIGS. 3(*a*) and 3(*b*) and shown by the solid line of FIG. 5.

That is, the regulating members 61A, 61B are rotatably supported on the axis, and its front edge is held at a predetermined lower limit position by a not shown stopper.

Then, the regulating member 61A is placed on the sheet S on the sheet discharge tray 60 as shown in FIG. 3(*a*), and the regulating member 61B is at the position which presses the side edge of the conveyance width direction of the sheet S.

In STEP 1, the first sheet S1 in the shift unit 1 is discharged on the sheet discharge tray 60. When the sheet S exists on the sheet discharge tray 60, the sheet S1 is placed on the sheet of the sheet discharge tray.

Hereupon, in the condition of STEP 1, the upper most surface of the sheet S is set at a predetermined position by the sensor 63. That is, the control section CR controls the motor M1 by the sheet surface detecting signal produced by the sensor 63, and makes the sheet discharge tray 60 up and down, and the upper most surface of the sheet S is maintained at a predetermined position.

In the condition shown in FIGS. 3(*a*) and 3(*b*), the regulating member 61B conducts one reciprocal movement of arrow mark W2 in FIG. 5, by the drive of motor M3, and the sheet S1 is brought into contact with the regulating member 61A (STEP 2).

In STEP 2, the regulating member 61A, which is the first regulating member, is fixed at the first reference position, and one direction alignment which the sheet S is aligned at the first reference position, is conducted by the regulating member 61B which is the second regulating member.

By this alignment movement of the regulating member 61B, the sheet S1 is aligned in the conveyance width direction.

In STEP 3, the second sheet S2 is discharged, in STEP 4, to the second sheet S2, the one direction alignment in the same manner as STEP 2, is conducted, and the sheet S2 is aligned.

Until the sheet S of numbers constituting the shift unit is discharged, the one direction alignment is conducted below.

On the stage in which one unit shift sheet discharge is completed, in STEP 5, the solenoid SL is operated and the pressing members 62A, 62B are rotatably driven counterclockwise, the pressing members 62A, 62B press the sheet S on the sheet discharge tray, and hold the sheet S not so as the alignment condition collapse.

In STEP 6, the sheet discharge tray 60 is lowered by a predetermined amount, by the drive of the motor M1, and is in the condition shown in FIG. 4.

In the condition of STEP 6, the lower ends of the regulating members 61A, 61B, and the uppermost surface of the sheet S are separated from each other.

By this separation, the regulating members 61A, 61B can move in the conveyance width direction, and the regulating members 61A, 61B respectively moves to the position of 61A1, 61B1 shown by the dotted line of FIG. 5 (STEP 7).

The movements in STEP 7 are conducted by the drive of motors M2, M3, and these movements are movements to a position that corresponds to a position where the sheet discharge position shifts in the conveyance width direction, for example, a position shifted by 30 mm from the solid line position of FIG. 5.

In the dotted line positions 61A1, 61B1, the regulating member 61B is positioned in the area of the sheet S, and the regulating member 61A is positioned out of area of the sheet S.

Next, in STEP 8, the motor M1 operates, and stops by the sheet detecting signal of the sensor 63, the sheet discharge tray 60 elevates again to the position of FIGS. 3(*a*) and 3(*b*).

In STEP 8, although the regulating member 61A is in out of area of the sheet S, because the regulating member 61B is in the area of the sheet S, the regulating member 61A is in the position which brought into contact with the side edge of the sheet S in the same manner as the regulating member 61B of FIG. 3(*b*), the regulating member 61B is on the sheet S in the same manner as the regulating member 61A of FIG. 3(*a*).

In STEP 9, the solenoid SL is turned off, the sheet pressure by the pressing members 62A, 62B is released.

In STEP 10, the first sheet S1 in the shift unit 2, is shifted in the opposite direction to the case of STEP 1, and discharged.

In STEP 11, the regulating member 61A reciprocates once in the conveyance width direction by the drive of the motor M1, the sheet S is brought into contact with the regulating member 61B, and aligned in another direction.

In STEP 11, the regulating member 61B which is the second regulating member is fixed at the second reference position, another direction alignment in which the sheet S is aligned at the second reference position is conducted by the regulating member 61A which is the first regulating member.

In STEP 12, the second sheet S2 is discharged, in STEP 13, another direction alignment in the same manner as STEP 11 is conducted.

The sheets S of the number of sheets constituting the shift unit 2 are delivered and thereafter, the alignment of another direction is conducted.

The shift unit 2 is formed by this sheet discharge and another direction alignment.

In case of multiple sheets discharge which form many shift units, the processing of FIG. 7 to the shift units 1, 2 is repeatedly conducted.

As described above, the present invention is described based on embodiments, however, the present invention includes various modification examples other than the embodiments.

For example, as the shift member, instead of the alignment plate, a device in which the conveying roller is moved in the rotation axis direction which is conveyance width direction and shifting is conducted, can be used.

Further, as the mechanism by which the sheet on the sheet discharge tray and the regulating member are separated, the mechanism by which the sheet discharge tray is not lowered, but the pressing member is elevated, can also be used.

In the present invention, under the condition that the regulating member which aligns the sheet on the sheet discharge tray, and the discharged sheet are separated on the sheet discharge tray, when the position relationship between the regulating member and the sheet discharge tray is changed, the alignment of the sheet corresponding to the shift sheet discharge is conducted on the sheet discharge tray.

Accordingly, the position at which the sheet grounds on the sheet discharge tray can be regulated high accurately.

However, the moving mechanism of the sheet discharge tray and regulating member are simple, and the sheet stacking apparatus and the sheet processing apparatus having low cost and high accurate sheet position aligning function are realized.

What is claimed is:

1. A sheet processing apparatus comprising:

a shift member adapted to discharge a sheet on a sheet stacking apparatus by displacing the sheet in a conveyance width direction; and the sheet stacking apparatus comprising:

a sheet discharge tray structured to support thereon discharged sheets, and to move upward and downward;

an alignment section including a first regulating member and a second regulating member with which the alignment section aligns a side edge of a sheet discharged on the sheet discharge tray;

a first drive section or moving the sheet discharge tray or the alignment section upward or downward;

a second drive section for moving the first regulating member and the second regulating member in a conveyance width direction; and a control section for controlling the first drive section and the second drive section;

wherein the control section controls the first drive section and the second drive section as to:

align the side edge of the sheet discharged on the sheet discharge tray on the basis of the position of the first regulating member, by fixing the position of the first regulating member and moving the second regulating member in the conveyance width direction;

when a predetermined amount of the sheets are discharged on the sheet discharge tray, separate the sheets discharged on the discharge tray from the first regulating member and the second regulating member by moving the sheet discharge tray or the alignment section and, after that, move the first regulating member and the second regulating member in the conveyance width direction; and align the side edge of the sheets discharged on the sheet discharge tray by fixing the position of the second regulating member and moving the first regulating member in the conveyance width.

2. An image forming system comprising:

an image forming apparatus for forming an image on a sheet; and the sheet processing apparatus of the claim 1 which carries out a post processing to a sheet carrying an image formed by the image forming apparatus.

3. The sheet processing apparatus of claim 1, further comprising:

a sensor adapted to detect an upper most surface of the sheets discharged on the discharge tray, wherein the control section controls, when sheets are discharged, the first drive section so as to maintain the uppermost surface of the sheets on the discharge tray based on a detection signal produced by the sensor.

4. The sheet processing apparatus of claim 1, further comprising: sheet pressing member to press the sheets on the discharge tray at least when separating the sheets discharged on the discharge tray from the first regulating member and the second regulating member.

5. The sheet processing apparatus of claim 1, wherein the first regulating member and the second regulating member are movable between a position at which the first and the second regulating members align the sheets and a retreat position.

6. The sheet processing apparatus of claim 1, wherein the control section controls so as to:

separate the sheets discharged on the discharge tray from the first regulating member and the second regulating member;

move the first regulating member and the second regulating member in the conveyance width direction; and make the first or the second regulating member contact with the sheets discharged on the discharge tray by driving the first drive section.

7. The sheet processing apparatus of claim 1, wherein the sheet processing apparatus comprises an intermediate tray for receiving a sheet discharged from an image forming apparatus, and the shift member displaces the sheet received on the intermediate tray.

* * * * *